US011639600B2

(12) United States Patent
Jarrett et al.

(10) Patent No.: US 11,639,600 B2
(45) Date of Patent: May 2, 2023

(54) STORM WATER RETENTION OR DETENTION SYSTEM AND MODULE THEREFORE

(71) Applicant: Jarrett Concrete Products, Ashland City, TN (US)

(72) Inventors: Travis Jarrett, Ashland City, TN (US); Landon Owen, Ashland City, TN (US)

(73) Assignee: Jarrett Concrete Products, Ashland City, TN (US)

( * ) Notice: Subject to any disclaimer, the term of this patent is extended or adjusted under 35 U.S.C. 154(b) by 0 days.

(21) Appl. No.: 17/467,711

(22) Filed: Sep. 7, 2021

(65) Prior Publication Data

US 2023/0073212 A1 Mar. 9, 2023

(51) Int. Cl.
*E03F 1/00* (2006.01)

(52) U.S. Cl.
CPC ..... *E03F 1/005* (2013.01)

(58) Field of Classification Search
CPC .. E03F 1/005; E03F 1/002; E03F 1/00; E02B 11/00; E02B 11/005
See application file for complete search history.

(56) References Cited

U.S. PATENT DOCUMENTS 4,983,069 A * 1/1991 Florence ..... E03F 1/005 405/36
6,991,401 B1 1/2006 Caron
7,160,058 B2 1/2007 Burkhart
7,344,335 B2 3/2008 Burkhart
8,360,100 B2 * 1/2013 Burkhart, Sr ..... E03F 1/003 210/170.03
8,770,890 B2 * 7/2014 May ..... E03F 5/101 405/51
8,985,897 B2 * 3/2015 Boulton ..... E03B 11/14 405/36
9,057,188 B2 * 6/2015 Burkhart, Sr. ..... E03F 5/101
9,546,044 B2 * 1/2017 Boulton ..... E03B 11/14
9,732,508 B1 * 8/2017 Kent ..... E03F 1/005
10,151,083 B2 * 12/2018 Kent ..... B65G 5/00
10,151,096 B2 * 12/2018 Kent ..... F17C 3/005
10,267,028 B2 * 4/2019 May ..... E03F 5/101
10,415,225 B2 * 9/2019 Zarraonandia ..... E03F 5/101
10,435,880 B1 * 10/2019 Elliott, Jr. ..... E01C 11/226
10,626,580 B2 * 4/2020 Kent ..... F17C 3/005
11,041,297 B2 * 6/2021 Zarraonandia ..... E03F 1/005
2009/0279953 A1 * 11/2009 Allard ..... E03F 1/005 405/39

(Continued)

FOREIGN PATENT DOCUMENTS

KR 20130039634 A * 4/2013
KR 20140029288 A * 3/2014
KR 101894576 B1 * 9/2018

*Primary Examiner* — Frederick L Lagman
(74) *Attorney, Agent, or Firm* — WCF IP

(57) ABSTRACT

A storm water retention or detention system is constructed to fit a desired land area from square shaped concrete modules. Each of the modules has at least one water passage and one air passage, and the water passages and air passages of adjacent concrete modules are in alignment to allow the free flow of water and air therebetween. The water passage may be circular, have a cross-sectional area less than 60% of the total area of a side of module, and be slightly above the bottom inside surface of the modules.

29 Claims, 7 Drawing Sheets

(56) References Cited

U.S. PATENT DOCUMENTS

| | | | | |
|---|---|---|---|---|
| 2010/0021236 | A1* | 1/2010 | Kreikemeier | E03F 1/005 405/55 |
| 2014/0105684 | A1* | 4/2014 | Allard | E02B 11/00 405/52 |
| 2019/0360190 | A1* | 11/2019 | Kent | F17C 3/005 |
| 2020/0011048 | A1* | 1/2020 | Kent | E03B 11/14 |

* cited by examiner

Top View

11'
20
10'
26
6"
28
11'
10'
6"
24
18
30
16
22
48"

Side View

10
Varies
7 5"
Varies
28
6" Anti-Air
Lock Hole
2"
4"
48" Bleed Hole
26
14
10
24
12
6"
7"
30

Top View

11'
11'
10'
10'
34
36
38
40
6"
48"
6"
32
Side View

Varies
7.5"
Varies
2"
38
6" Anti-Air
Lock Hole
4"
34
48" Bleed Hole
32
6"
7"

Top View

Side View

Top View

Side View

Top View

11'
11'
10'
10'
6"
64
65
48"
6"

Side View 62
62
7"
7.5"
4"
65
6" Anti-Air
Lock Hole
Varies
Varies
2"
64
48" Bleed Hole
6"

Side View

126
RCP
118
122
Steps
110
130
116
132
112
120
124
Steps
114
134
128
RCP
8.13'

Top View 70
102
RCP
72
62
Access Hole
106
74
84
88
76
90
92
86
94
78
96
100
108
Access Hole
98
80
104
RCP
22'
33'

Top View

STORM WATER RETENTION OR DETENTION SYSTEM AND MODULE THEREFORE

FIELD OF THE INVENTION

The invention generally relates to storm water retention and detention systems often utilized in urban settings such as Nashville, Tenn., and more particularly to modular pre-cast concrete storm water retention and detention systems.

BACKGROUND

Storm water retention and detention systems are used in urban settings where the cost of land is high, and other systems for diverting and retaining storm water such as ponds, reservoirs, and the like which require land resources are less desirable. These systems are typically made of concrete, and have one or more inlets and outlets to take in water and hold it for a period of time before releasing it back into the environment in a controlled manner to a desired location. This decreases pooling of water around buildings and other structures, and the system can be set up under or adjacent to a building and therefore requires less land resources than traditional ponds and reservoirs.

Storm water retention and detention systems can be custom designed to fit any land use space. However, a number of companies have developed modular systems which enable adaptively setting up a system for virtually any space. Examples of modular systems are found in U.S. Pat. Nos. 6,991,401, 7,160,058, and 7,344,335, each of which are herein incorporated by reference. Alternative modular designs are commercially available from Old Castle Infrastructure. Despite the recent advances in modular storm water retention and detention systems, there is a need for improved and more robust systems which allow for more flexible adaptability to land spaces, easier installation, improved storm and run off water handling, and the like.

SUMMARY

In one aspect of the invention a substantially square module is constructed for use in a storm water retention an detention system which can be configured for use with a plurality of similar modules to adaptively fit into multiple land space configurations.

It is another aspect of the invention to provide a module with more wall space for water containment and detention than currently available modules.

It is yet another aspect of the invention to provide storm water retention and detention systems comprised of a plurality of square modules.

It is still another aspect of the invention to provide storm water retention and detention systems comprised of a plurality of modules with improved air handling features.

It is another aspect of the invention to provide methods for installing storm water retention and detention systems.

According to the invention, a storm water retention or detention system is constructed to fit a desired land area from square shaped concrete modules. Each of the modules has at least one water passage and one air passage, and the water passages and air passages of adjacent concrete modules are in alignment to allow the free flow of water and air therebetween. The water passage may be circular, have a cross-sectional area less than 60% of the total area of a side of module, and be slightly above the bottom inside surface of the modules. The top of only one or the tops of only a few of the modules include ports such as access ports above the surface of the storm water retention or detention system. The external surface, formed from the walls of a plurality of concrete modules, do not include the water passages which allow water flow between adjacent modules, except that one or more of the concrete modules have water inlet ports and one or more different concrete modules include water outlet ports to allow water to flow into and out of the storm water retention and detention system.

DETAILED DESCRIPTION

Figure 1B:
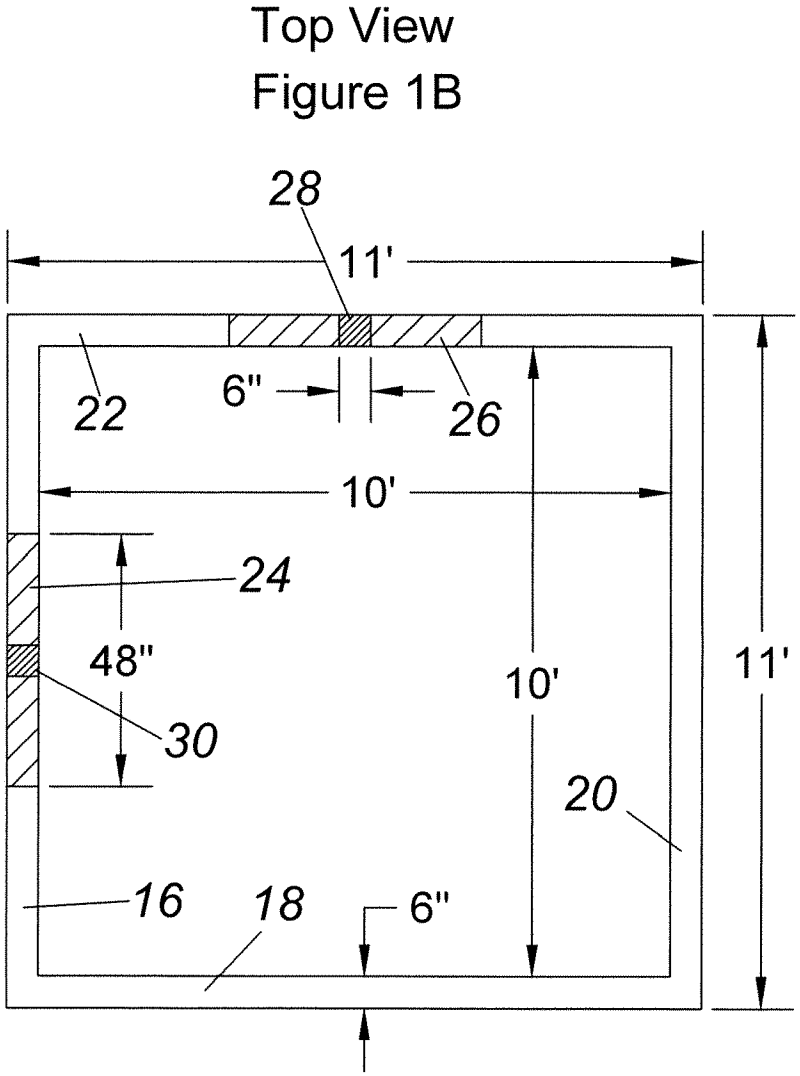
FIGS. 1A and 1B are side and top views of a concrete module used in a storm retention and detention system where water passage openings are on two adjacent side walls.
Figure 1A:
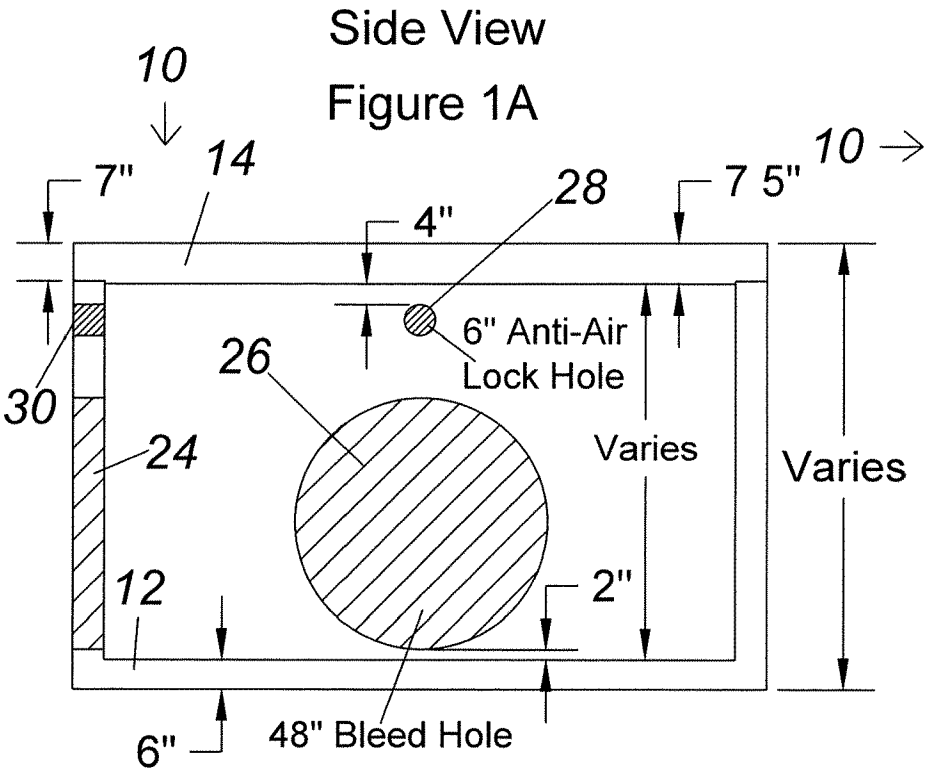

With reference to FIGS. 1A and 1B there is shown an example of a concrete module 10 for use in assembling a storm retention or detention system. The thicknesses and heights presented in the drawings are for exemplary purposes and can be varied considerably within the practice of the invention. FIG. 1A shows the module 10 has a bottom floor 12 and a top 14, and FIG. 1B shows the module 10 has four side walls 16, 18, 20, and 22.

The module 10 is a square shape. The square shape allows for a more robust ability to adapt to the shape of a variety of different land areas. Rectangular configurations can put impediments on the final lay out storm retention and detention system, and can be more difficult to align and connect.

FIG. 1A and FIG. 1B show the thickness of the floor 12 and side walls 16, 18, 20, and 22 to be approximately six inches. However, the thickness of the concrete may very depending on the application, with four to ten inches being suitable for most applications. FIG. 1B shows the module being approximately eleven feet on a side, which, given a six inch wall thickness produces a module 10 with an interior ten feet on a side. The length of the side may vary depending on the application, and a square shape ranging from six to fifteen feet on each of the four sides being suitable for most applications. FIG. 1A shows that the bottom 12 is integral with the side walls. This provides for better water handling capabilities; however, in some applications the walls might simply be joined to the bottom and the joints would be sealed with caulk, grout, or other suitable materials. FIG. 1B shows the top 14 resting on the top edges of the side walls. This configuration allows for easy set up and sealing within the modules with the tops being lifted into place with a crane or other device when the storm retention or detention system is assembled. However, in some applications the top 14 may be formed integrally with the side walls 16, 18, 20, and 22, and bottom 12. In FIG. 1A the top is shown as being approximately seven inches thick; however, this thickness may range from four to twelve inches depending on the application. As will be discussed in more detail below, not every module 10 requires an access port (not shown) extending through the top with the inventive storm water retention and detention system.

FIGS. 1A and 1B show two large water passage holes 24 and 26 in side walls 16 and 22 respectively. These passage holes 24 and 26 extend wholly through the side walls and allow water to pass freely between the module and an adjacent module. In a preferred design the water passage holes 24 and 26 are circular in shape and may be, for example, four feet in diameter. Preferably, the opening of the water passage holes 24 and 26 are well less than, for example, 60%, 50%, or even 40%, the total area of the wall in which it is located. For example, in FIGS. 1A and 1B the inside wall as a total area of 50 square feet while the four foot diameter water passage is less than 13 square feet. This extra surface area helps with water containment within each of the modules 10 in a storm retention or detention system and makes the entire assembly stronger. Depending on the application, the shape of the holes need not be circular (e.g., rectangular, triangular, or other polygonal are suitable), however, the circular design provides for more structural stiffness, and makes alignment of adjacent modules 10 easier when assembling the storm retention and detention system from a plurality of modules. In addition, in some applications and/or for some modules, the opening in the side wall for allowing water passage may be greater than 60% of the total area of the wall.

FIGS. 1A and 1B also show six inch diameter air holes 28 and 30 positioned above the water passage openings 26 and 24 respectively. The air holes 28 and 30 need not be circular and could be larger or smaller, and in some applications there could be more than one air hole in a wall. The air holes allow air to be move from one module to another, and eventually out of the storm retention or detention system through a port in a side wall of a module at the side of the system or ports in a top of one of the modules in the system. When water begins to fill up the storm retention or detention system during a heavy storm for example, air present within the system will begin to compress and will need to exit the system as modules fill with water. When the storm retention or detention system is assembled, the air holes 28 and 30 of adjacent modules 10 are aligned in the same manner as the water passage openings 24 and 26.

FIG. 1A also shows the water passage opening 26 is located slight above the top surface of the floor 12 of the module, for example, two inches above. The height above the bottom surface can vary, and in some applications is not required. The slight elevation of the water passage opening 26 can provide some benefits in the manufacturing of the module, as well as structural integrity advantages.

Figures 2A, 2B:
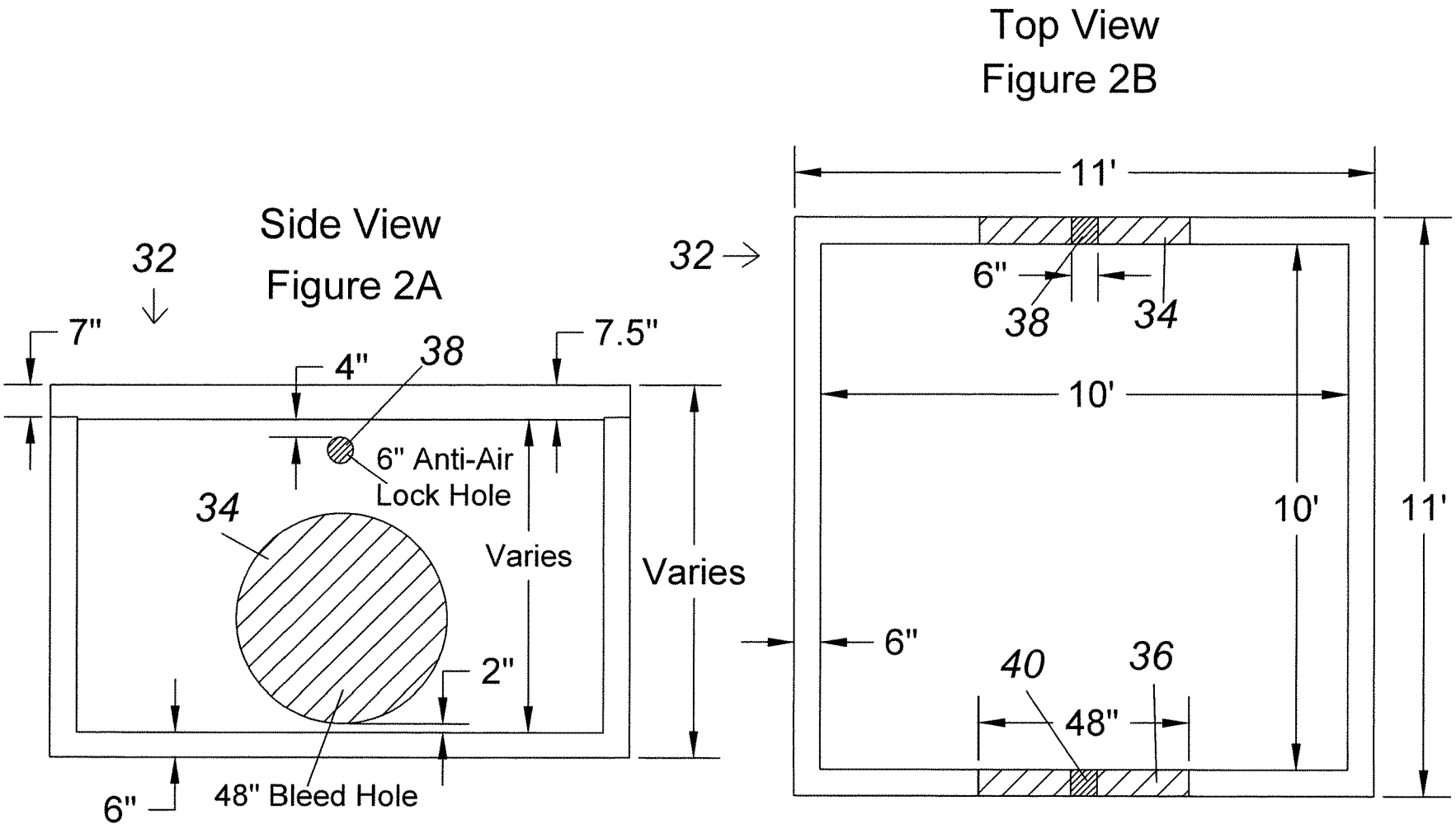
FIGS. 2A and 2B are side and top views of a concrete module where water passage openings are on opposite side walls.
Figure 3B:
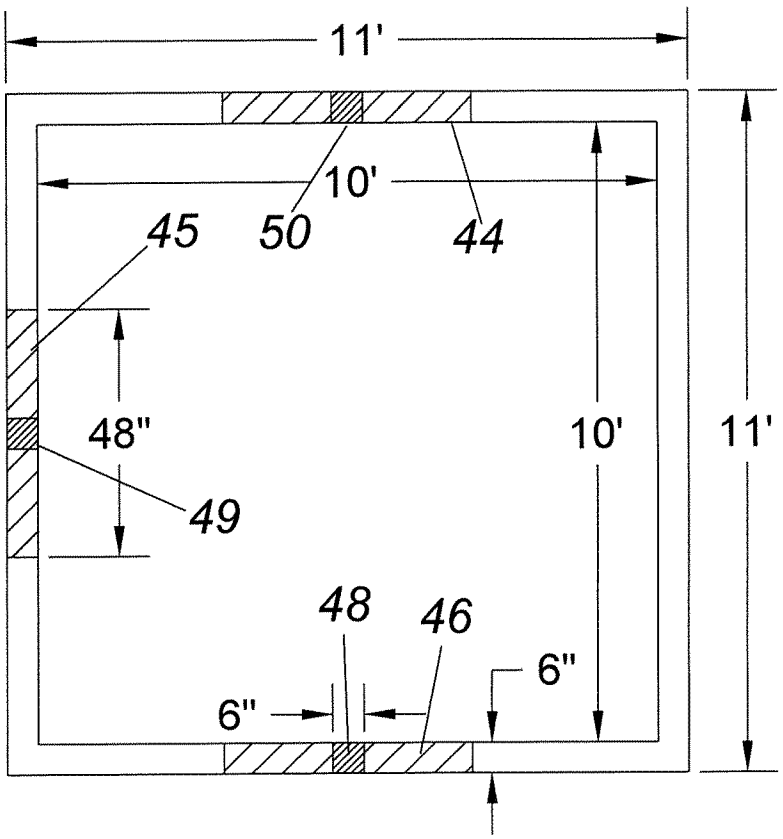
FIGS. 3A and 3B are side and top views of a concrete module where water passage openings are on three of the four side walls.
Figure 3A:
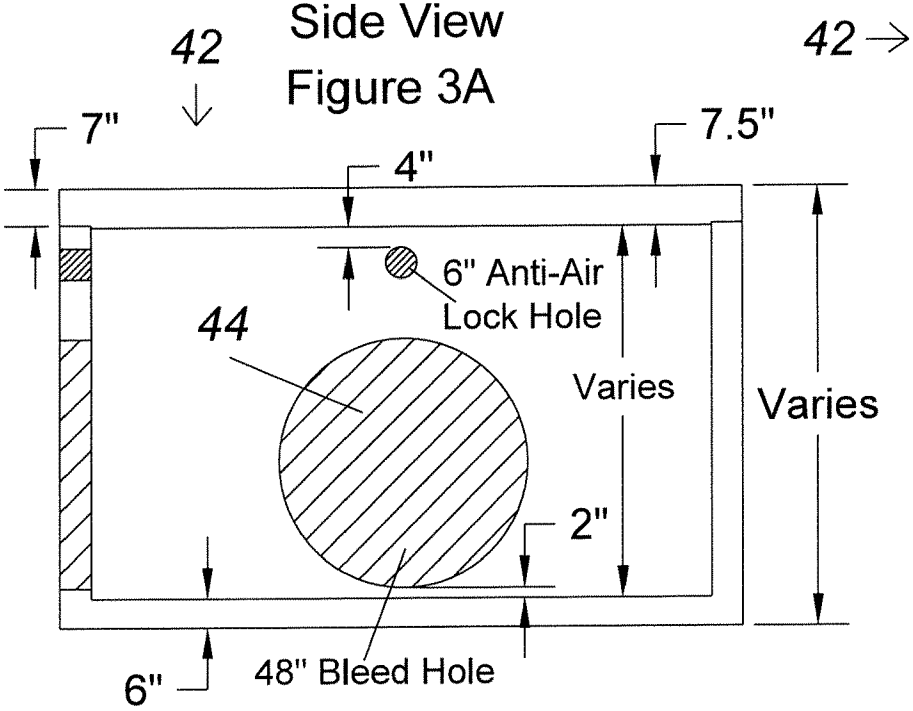
Figure 4B:
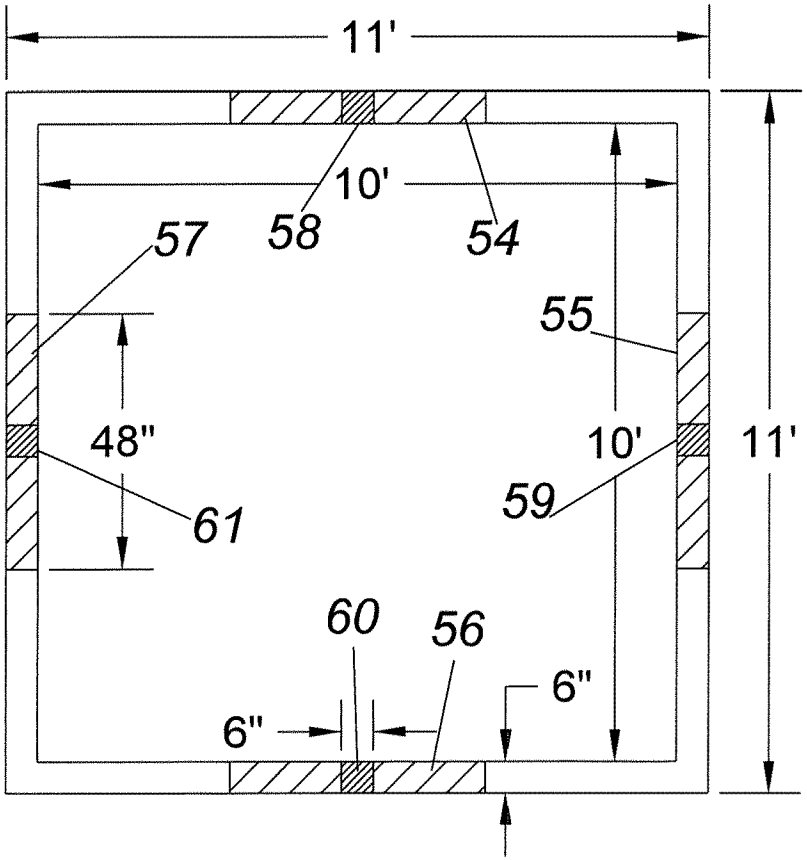
FIGS. 4A and 4B are side and top views of a concrete module where water passage openings are on all four side walls.
Figure 4A:
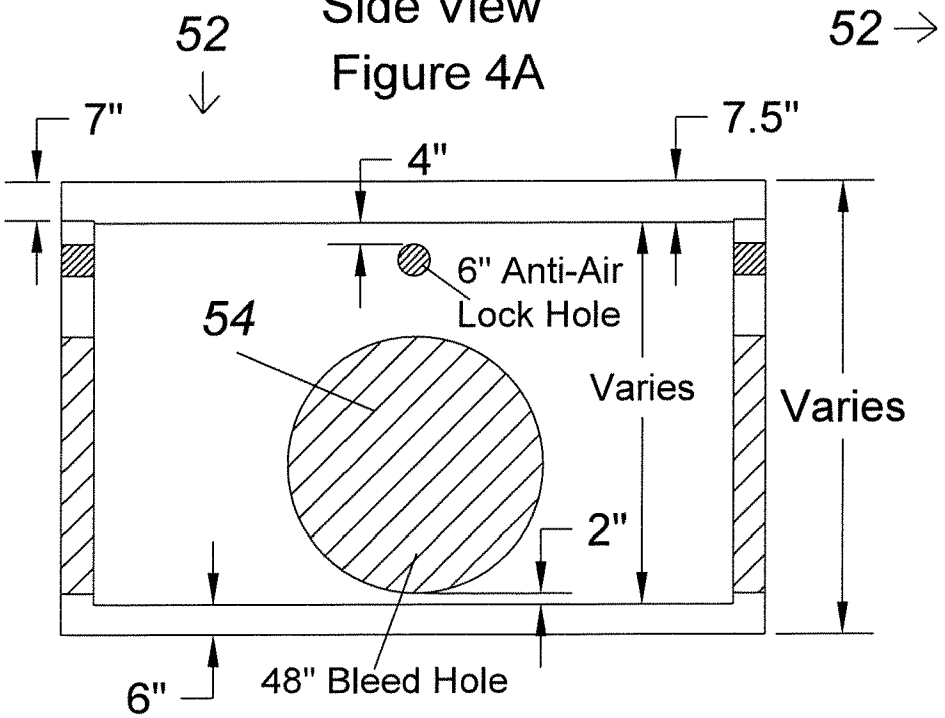
Figure 5B:
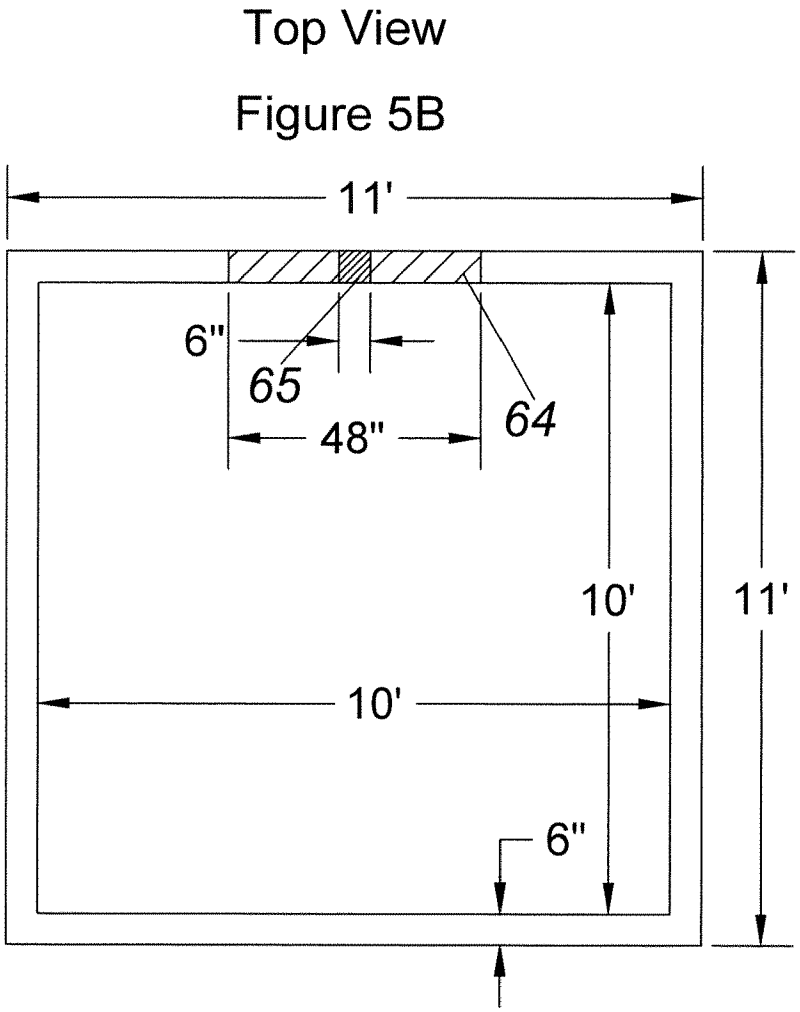
FIGS. 5A and 5B are side and top views of a concrete module where a water passage opening is on only one of the four side walls.
Figure 5A:
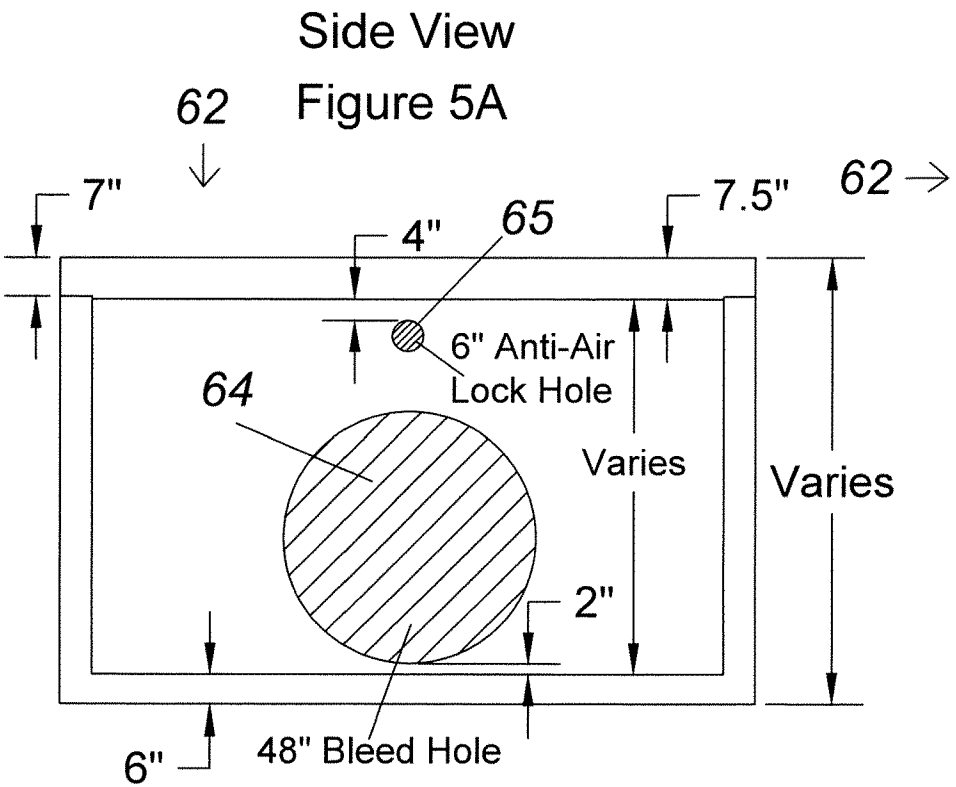

A variety of modules similar to those depicted in FIGS. 1A and 1B are possible. FIGS. 2A and 2B show an example of a concrete module 32 for a storm water retention or detention system which has water passage openings 34 and 36 and air passages 38 and 40 on opposing walls. FIGS. 3A and 3B show an example of a concrete module 42 where three of the walls include water passages 44, 45, and 46, and air passages 48, 49, and 50. FIGS. 4A and 4B show an example of a concrete module 52 where each of the four walls include water passages 54, 55, 56, and 57, and air passages 58, 59, 60, and 61. FIGS. 5A and 5B show an example of a concrete module 62 which has only a water passage 64 and air passage 65 on a single wall. The concrete module may be used around the exterior of the storm water retention or detention system to provide extra storage capacity, and might also be equipped with a rain water inlet or outlet pipe (not shown; discussed below).

Figure 6B:
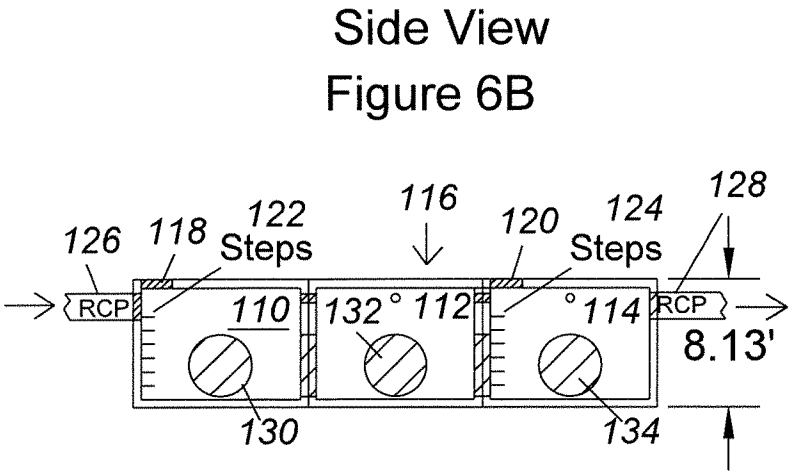
FIG. 6B is a cut away side view of a portion of a storm retention and detention system.
Figure 6A:
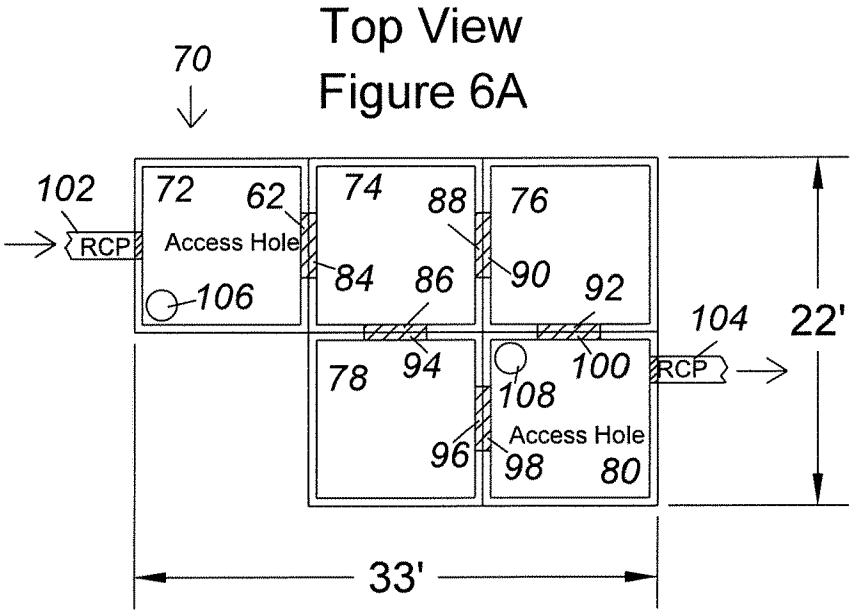
FIG. 6A is a top view of a five module storm retention and detention system.

FIG. 6A shows storm water retention and detention system 70 comprised of five concrete modules 72, 74, 76, 78, and 80. It can be seen that concrete module 72 has a single water passage 82, like that shown in FIGS. 5A and 5B, which is aligned with water passage 84 of concrete module 74. Concrete module 74 has three water passages 84, 86, and 88, similar to the concrete module depicted in FIGS. 3A and 3B. Concrete modules 76, 78, and 80 are similar to the concrete module depicted in FIGS. 1A and 1B with water passages 90, 92, 94, 96, 98, and 100 on two of the adjacent side walls of the respective module. Each of the water passages 90, 92, 94, 96, and 98 are aligned with a water passage of a neighboring module. When the storm water retention and detention system 70 is constructed, after the modules 72, 74, 76, 78 and 80 are positioned next to one another, caulk, grout or other materials may be applied at the line between the aligned, adjacent water passages to provide for water tightness.

FIG. 6A shows a water inlet port 102 passing through the side wall of concrete module 72, and a water outlet port 104 passing through the side wall of the concrete module 80. The water inlet port 102 and water outlet port 104 may be installed before or after assembly of the storm water retention and detention system 70. The water inlet port 102 and water outlet port 104 may be installed anywhere on the wall (e.g., in the center as in concrete module 72, or toward an edge as in concrete module 80). Preferably, all of the exterior walls of the storm water detention and retention system are solid, without a water passage, except for inlet and outlet ports on some of the exterior walls. This enables storm water to be directed to the storm water retention and detention system 70, and fill up and flow between the modules 72, 74, 76, 78, and 80, before being discharged in a controlled manner and direction by water outlet port 104. FIG. 6A shows that only a few of the modules, e.g., 72 and 80, can include access holes 106 and 108, and this will still allow access to the entire storm water retention or detention system structure. While not shown, the access holes 106 and 108 can provide air venting, and other holes (not shown) may be provided in the tops of some of the modules 72, 74, 76, 78, and 80 for air venting.

FIG. 6B shows a three module 110, 112, and 114, portion of a storm water retention or detention system 116. Notably, the access ports 118 and 120 may include a set of steps or ladder elements 122 or 124 to allow a person to descend inside of the storm water retention or detention structure for servicing, maintenance, etc. FIG. 6B also shows water inlet port 126 and water outlet port 128 located high on the outer walls of concrete modules 110 and 114, above the top level of the water passages 130, 132, and 134 between adjacent modules. The location of the water inlet port 126 and 128 in terms of height above the floor of the storm water retention or detention system 116 can vary depending on the application, and need not be at the same height as shown in FIG. 6B or necessarily well above the top of the water passages 130 132, and 134.

Figure 7:
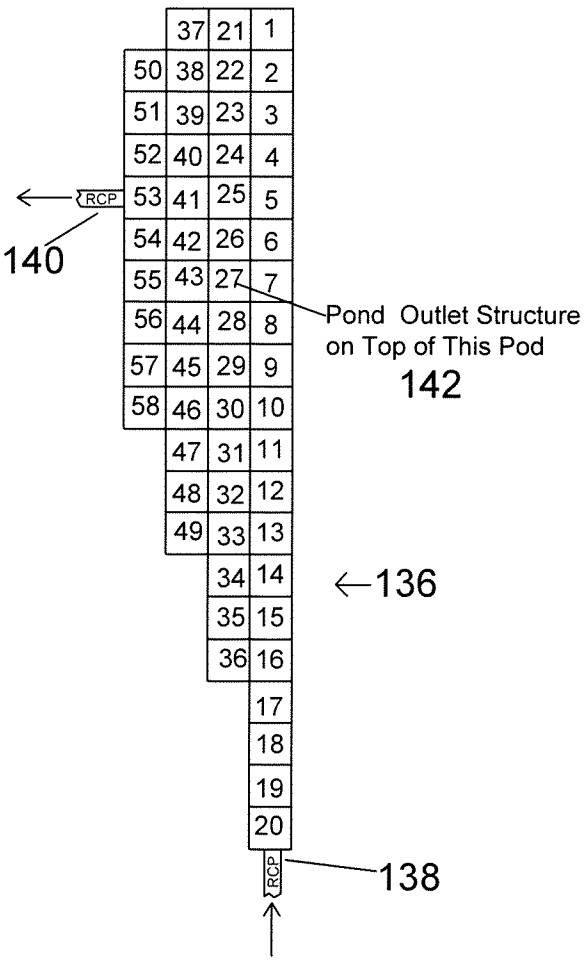
FIG. 7 is a schematic top view of a fifty eight module storm retention and detention system.

FIG. 7 shows that the storm water retention or detention systems 136 can be extremely large and can adapt to the shape of virtually any land space area. For example, FIG. 7 shows a storm water retention or detention system 136 constructed from fifty eight individual concrete modules, where the structure varies from one module wide to four modules wide, and from twenty modules long to nine modules long. FIG. 7, like FIG. 6A, shows that the water inlet 138 and the water outlet 140 need not be in alignment. While not shown, storm water retention or detention systems like that depicted as 136 in FIG. 7 may have more than one water inlet and/or more than one water outlet. In addition, structures, such as a pond outlet (not shown) may be constructed on top of one or more selected modules 142.

While the invention has been described in terms of its preferred embodiments, those of skill in the art will recognize that the invention may be practiced with variation within the scope of the appended claims.

The invention claimed is:

1. A concrete module for use in a storm water retention or detention system, comprising:

a bottom floor substantially square in shape and ranging from six to fifteen feet on each of four sides;

four side walls, each extending upward three to ten feet from one of the four sides of the bottom floor, and each having a top edge, wherein one or more of the four side walls comprises a water passage opening that extends through a thickness of the one or more of the four side walls and has one or more attributes selected from the group consisting of i) is circular in shape, ii) has an area that is equal to or less than 60% of a total area of the one or more side walls, and iii) is positioned in the one or more side walls at a location above a top of the bottom floor, wherein the one or more side walls that comprises the water passage comprises at least one air passage opening that extends through the thickness of the one or more of the four side walls, wherein the at least one air passage is positioned in the one or more of the four side walls above the water passage opening relative to the bottom floor wherein the at least one air passage opening and the water passage opening are in a same one or more of the four side walls and are configured to be alignable with another at least one air passage and another water passage in another concrete module; and a top which fits on the concrete module above the bottom floor, wherein the top has four sides and each of the four sides of the top is configured to fit on one of the top edges of one of the four side walls.

2. The concrete module of claim 1 wherein the top has one or more openings which extends from a top surface the concrete module to a second surface inside the concrete module.

3. The concrete module of claim 2 wherein said one or more openings is an access opening sized to permit a person to enter the inside of the concrete module.

4. The concrete module of claim 2 wherein the top is integrated with the four side walls.

5. The concrete module of claim 2 wherein the top rests on the top edges of each of the four side walls.

6. The concrete module of claim 1 wherein at least two of the four side walls include the water passage opening and the one or more air passages.

7. The concrete module of claim 1 wherein at least three of the four side walls include the water passage opening and the one or more air passages.

8. The concrete module of claim 1 wherein the four sides of the bottom floor range from 8 to 12 feet on a side.

9. The concrete module of claim 1 wherein the four sides of the bottom floor are 11 feet on a side.

10. The concrete module of claim 1 wherein the thickness of the one or more of the four side walls ranges from 4 to 10 inches.

11. The concrete module of claim 1 wherein the thickness of the one or more of the four side walls is six inches.

12. The concrete module of claim 1 wherein the water passage opening includes at least attribute i).

13. The concrete module of claim 1 wherein the water passage opening includes at least attribute ii).

14. The concrete module of claim 13 wherein the water passage opening has an area of equal to or less than 50% of the total area of the one more side walls.

15. The concrete module of claim 1 wherein the water passage opening includes at least attribute iii).

16. The concrete module of claim 1 wherein the water passage opening includes at least two of attributes of i), ii), and iii).

17. The concrete module of claim 1 wherein the water passage opening includes each of attributes of i), ii), and iii).

18. The concrete module of claim 1 wherein each of the four side walls extend upward three to 7 feet from one of the four sides of the bottom floor.

19. The concrete module of claim 1 wherein each of the four side walls extend upward 5 feet from one of the four sides of the bottom floor.

20. A storm water retention or detention system, comprising a plurality of concrete modules as recited in claim 1, wherein each concrete module of said plurality of concrete modules has at least one side wall abutting against at least one side wall of an adjacent concrete module, and wherein at least two of the plurality of concrete modules which are abutting have the water passage opening and the at least one air passage opening in alignment such that water and air can pass freely from a first of the two of the plurality of concrete modules to a second of the two of the plurality of concrete modules.

21. The storm water retention or detention system of claim 20 wherein one or more of the plurality of concrete modules comprises a water inlet port extending through a wall of the four side walls one or more concrete modules wherein the wall is on an external side of the storm water retention or detention system, wherein one or more of the plurality of concrete modules comprises a water outlet port extending through a wall of the four side walls one or more concrete modules wherein the wall is on an external side of the storm water retention or detention system, and wherein the one or more concrete modules comprising the water inlet port are different from the one or more concrete modules comprising the water outlet port.

22. The storm water or detention system of claim 21 wherein the concrete module walls on the external side of the storm water retention or detention system do not include the water passage opening.

23. The storm water retention or detention system of claim 20 wherein the top of one or the tops of some but not all of the plurality of concrete modules comprises one or more openings which extends from a top surface the concrete module to a second surface inside the concrete module.

24. The storm water retention or detention system of claim 20 wherein the plurality of concrete modules includes at least five concrete modules.

25. The storm water retention or detention system of claim 20 wherein the plurality of concrete modules includes at least twenty concrete modules.

26. A method of producing a storm water retention or detention system of claim 20, comprising:

placing the plurality of concrete modules in a predetermined pattern with side walls of adjacent concrete modules being placed such that for every two of the plurality of concrete modules which are abutting the water passage opening and the at least one air passage opening are in alignment such that water and air can pass freely from a first of the two of the plurality of concrete modules to a second of the two of the plurality of concrete modules; and applying a sealant between the water passage opening of the first of the two of the plurality of concrete modules and the water passage opening of the second of the two of the plurality of concrete modules.

27. The method of claim 26 wherein the placing step is performed such that the concrete module walls on an external side of the storm water retention or detention system do not include the water passage opening.

28. The method of claim 27 further comprising connecting one or more water inlets and one or more water outlets to different concrete modules in the storm water retention or detention system on the external side of the storm water retention or detention system.

29. The method of claim 26 further comprising connecting one or more water inlets and one or more water outlets to different concrete modules in the storm water retention or detention system.

* * * * *